US008411886B2

(12) United States Patent
Barthel et al.

(10) Patent No.: US 8,411,886 B2
(45) Date of Patent: Apr. 2, 2013

(54) HEARING AID WITH AN AUDIO SIGNAL GENERATOR

(75) Inventors: Roland Barthel, Erlangen (DE); Wolfgang Sörgel, Erlangen (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 1221 days.

(21) Appl. No.: 11/888,884

(22) Filed: Aug. 2, 2007

(65) Prior Publication Data

US 2008/0031480 A1 Feb. 7, 2008

(30) Foreign Application Priority Data

Aug. 4, 2006 (DE) ..... 10 2006 036 580

(51) Int. Cl.
*H04R 25/00* (2006.01)

(52) U.S. Cl. ..... 381/314; 381/23.1; 381/313; 381/315; 381/316; 381/118; 381/119; 381/120; 381/121; 381/122

(58) Field of Classification Search ..... 381/23.1, 381/313–316, 118–122
See application file for complete search history.

(56) References Cited

U.S. PATENT DOCUMENTS

| | | | | |
|---|---|---|---|---|
| 2,084,180 | A * | 6/1937 | Barton | 381/120 |
| 4,622,878 | A * | 11/1986 | Sharp | 84/626 |
| 4,751,738 | A * | 6/1988 | Widrow et al. | 381/313 |
| 4,843,623 | A * | 6/1989 | Lafon et al. | 381/316 |
| 4,993,073 | A * | 2/1991 | Sparkes | 381/119 |
| 5,210,803 | A | 5/1993 | Martin et al. | |
| 5,375,188 | A * | 12/1994 | Serikawa et al. | 704/215 |
| 5,444,676 | A * | 8/1995 | Balsamo et al. | 369/4 |
| 5,524,150 | A | 6/1996 | Sauer | |
| 5,652,797 | A * | 7/1997 | Okamura et al. | 381/61 |
| 6,115,478 | A | 9/2000 | Schneider | |
| 6,394,969 | B1 | 5/2002 | Lenhardt | |
| 6,424,721 | B1 * | 7/2002 | Hohn | 381/313 |
| 6,539,096 | B1 * | 3/2003 | Sigwanz et al. | 381/313 |
| 6,879,692 | B2 * | 4/2005 | Nielsen et al. | 381/60 |
| 7,031,483 | B2 * | 4/2006 | Boone et al. | 381/313 |
| 7,039,203 | B2 * | 5/2006 | Heyl | 381/119 |
| 7,054,452 | B2 * | 5/2006 | Ukita | 381/92 |
| 7,062,336 | B1 * | 6/2006 | Yang et al. | 700/94 |
| 7,088,224 | B2 * | 8/2006 | Nakagawa et al. | 340/407.1 |

(Continued)

FOREIGN PATENT DOCUMENTS

| | | |
|---|---|---|
| DE | 42 06 084 C1 | 3/1992 |
| DE | 42 17 629 A1 | 12/1993 |

(Continued)

OTHER PUBLICATIONS

Communication from European Patent Office, Oct. 7, 2011, pp. 1-6.

*Primary Examiner* — Fernando L Toledo
*Assistant Examiner* — Mohammed Shamsuzzaman

(57) ABSTRACT

The invention relates to a hearing aid with at least one sound receiver and a sound generator. The hearing aid has an audio signal unit operatively connected to the sound generator, the audio signal unit being designed to generate an audio signal perceptible to a human ear. The audio signal has a plurality of mutually different frequencies of a frequency range. The audio signal unit has at least one tone generator. The at least one tone generator is designed to generate the audio signal with at least one fundamental frequency representing a tone and with harmonics of the fundamental frequency.

14 Claims, 3 Drawing Sheets

U.S. PATENT DOCUMENTS

| | | | | |
|---|---|---|---|---|
| 7,236,838 | B2 * | 6/2007 | Katayama et al. | 700/94 |
| 7,388,959 | B2 * | 6/2008 | Gagon | 381/98 |
| 7,561,931 | B1 * | 7/2009 | Kato et al. | 700/94 |
| 7,564,980 | B2 * | 7/2009 | Zurek et al. | 381/60 |
| 7,643,641 | B2 * | 1/2010 | Haulick et al. | 381/92 |
| 7,728,658 | B2 * | 6/2010 | Andersen et al. | 330/10 |
| 7,822,212 | B2 * | 10/2010 | Merline et al. | 381/57 |
| 7,945,056 | B2 * | 5/2011 | Burger | 381/92 |
| 2002/0021814 | A1 * | 2/2002 | Roeck | 381/312 |
| 2003/0152243 | A1 * | 8/2003 | Julstrom et al. | 381/315 |
| 2004/0234089 | A1 * | 11/2004 | Rembrand et al. | 381/312 |
| 2005/0152561 | A1 * | 7/2005 | Spencer | 381/77 |
| 2006/0269088 | A1 * | 11/2006 | Julstrom et al. | 381/315 |
| 2007/0084331 | A1 * | 4/2007 | Haken | 84/600 |
| 2007/0269064 | A1 * | 11/2007 | Allegro-Baumann et al. | 381/313 |
| 2008/0069383 | A1 * | 3/2008 | Kohno et al. | 381/119 |

FOREIGN PATENT DOCUMENTS

| | | | |
|---|---|---|---|
| DE | 198 25 750 | A1 | 1/2000 |
| DE | 698 28 160 | T2 | 2/2000 |
| EP | 0 480 097 | A1 | 4/1992 |
| EP | 0820211 | A1 | 1/1998 |
| EP | 1467595 | A2 | 10/2004 |
| EP | 0 985 328 | B1 | 3/2006 |
| EP | 1651005 | A2 | 4/2006 |

* cited by examiner

HEARING AID WITH AN AUDIO SIGNAL GENERATOR

CROSS REFERENCE TO RELATED APPLICATIONS

This application claims priority of German application No. 10 2006 036 580.1 filed Aug. 4, 2006, which is incorporated by reference herein in its entirety.

FIELD OF THE INVENTION

The invention relates to a hearing aid with at least one sound receiver and a sound generator, the at least one sound receiver being designed to receive sound waves and to generate a microphone signal representing the received sound waves. The hearing aid also has a transmission unit which is connected on the input side to the at least one sound receiver and on the output side to the sound generator. The transmission unit is designed to receive the microphone signal on the input side and to generate a power signal at least partially representing the microphone signal as a function of the microphone signal received on the input side. The sound generator is designed to receive the power signal on the input side and to generate a sound corresponding to the power signal as a function of the power signal received on the input side.

BACKGROUND OF THE INVENTION

Hearing aids known from the prior art can generate an acknowledgement tone as a function of an event. This acknowledgement tone is often perceived as unpleasant or is not noticed by a hearing aid user if a frequency of the acknowledgement tone falls within a frequency range at which the user's hearing is impaired.

DE 42 06 084 discloses a hearing aid with a tone generator connected to an earpiece of the hearing aid, the tone generator being able to generate an audio frequency signal in the form of a voice signal. The audio frequency signal can be reproduced via the earpiece of the hearing aid.

DE 198 25 750 A1 discloses a hearing aid with a tone generator which can generate an electrical signal as a function of an event signal generated by a test module, the event signal representing the charging state of a battery connected to the hearing aid. The tone signal can be reproduced via an earpiece of the hearing aid.

DE 42 17 629 A1 discloses a hearing aid with a voice signal generator which is connected to an earpiece of the hearing aid and can generate a voice signal as a function of a selected transmission parameter and reproduced it via the earpiece.

DE 698 28 160 T2 discloses a hearing aid which can generate an audible verification signal and reproduce it via an earpiece of the hearing aid. The audible verification signal can be generated as a function of a successful hearing aid programming operation.

SUMMARY OF THE INVENTION

The object of the invention is therefore to specify a hearing aid allowing improved communication with the hearing aid user.

This object is achieved by a hearing aid of the type described in the introduction, wherein the hearing aid has an audio signal unit operatively connected to the sound generator, the audio signal unit being designed to generate an audio signal perceptible to a human ear. The audio signal has a plurality of mutually different frequencies of a frequency range. The advantage of this is that the user with impaired hearing can perceive the audio signal which is intended in particular for communicating with the user.

The audio signal unit preferably has at least one tone generator. The at least one tone generator is designed to generate the audio signal with at least one fundamental frequency representing a tone and with harmonics of the fundamental frequency, thereby advantageously enabling the audio signal to be generated in a memory saving manner. For this purpose the tone generator can have at least one input for a generation parameter and can be designed to generate the audio signal as a function of the at least one generation parameter. For example, the at least one tone generator can generate a sequence of tone signals each representing a tone with a fundamental frequency and with harmonics of the fundamental frequency and which together constitute the audio signal. In this way a melody represented by the audio signal can be advantageously generated in a memory saving manner.

In a preferred embodiment, the audio signal represents an instrumental and/or vocal sound. This means that the audio signal is perceived as particularly pleasant by the hearing aid user.

Even more advantageously, an instrumental or vocal sound contains a large number of frequencies of a frequency range and therefore encompasses a wide frequency band. This enables the hearing aid user to detect the audio signal clearly even if his hearing is impaired.

In an advantageous variant, the at least one tone generator is designed to generate the audio signal at least partially by means of frequency modulation synthesis. In this way, the audio signal unit can advantageously simulate at least one instrumental sound in close approximation to a natural sound of at least one instrument.

Typical examples of an instrumental sound can be, for example, an instrumental sound of a keyboard instrument, in particular a piano sound, a harpsichord sound, an organ sound, or a sound of a wind instrument, in particular a flute, an oboe, a bassoon, a trumpet, a trombone, a horn, a clarinet or of a stringed instrument, in particular a violin, a viola, a cello or a double bass, or of a plucked string instrument, in particular a mandolin, a guitar in particular an electric guitar, a zither, or of a percussion instrument, in particular a drum, a kettledrum, a cymbal, a cow bell, a triangle or a castanet.

An audio signal can represent a melody comprising a plurality of simultaneously and/or consecutively sounding tones or chords, wherein a tone represents a vocal or instrumental sound.

An instrumental sound represented by an audio signal can comprise at least one tone constituting an interval such as a unison, second, third, fourth, fifth, sixth, seventh, octave, and other intervals, in particular perfect, diminished, augmented or major/minor. For this purpose the audio signal unit can have at least two, preferably a plurality of tone generators.

In another embodiment, the audio signal unit is designed to generate the audio signal by means of a digital waveguide model which simulates natural wave guiding in a musical instrument.

An audio signal representing a vocal sound can represent, for example, a vocal sound of at least one human voice or of a plurality of human voices.

In another embodiment, the audio signal represents a noise signal. A noise signal can represent, for example, white noise, pink noise, in particular one-third octave band noise or noise which is limited by another frequency interval.

In a preferred embodiment, the at least one tone generator is designed to generate the audio signal at least partially by means of amplitude modulation. A tremolo for the audio signal can be advantageously generated in this way so that the audio signal can advantageously be detected by the user against possible interfering background noise. For this purpose, the tone generator can have a tremolo element designed for amplitude modulation.

In a preferred embodiment, the at least one tone generator has a vibrato element which is designed to generate the audio signal at least partially by means of additional frequency modulation. This enables a vibrato to be advantageously formed so that the audio signal can advantageously be detected by the user against possible interfering background noise.

In an advantageous variant, an audio signal segment of the audio signal representing a tone can have an amplitude envelope, an end segment of the audio signal segment having a falling amplitude envelope.

This means that an audio signal, in particular the amplitude envelope of the audio signal, can advantageously decay gradually which may be perceived as pleasant by the user. An amplitude envelope of the end segment of the audio signal segment preferably falls off exponentially.

Exemplary embodiments for tones which can be represented by the audio signal segment are tones generated by percussion instruments, such as a xylophone tone, a metallophone tone, a triangle tone, a kettledrum tone, a drum tone, a bell tone, a gong tone or a tone produced by one of the above-mentioned plucked string instruments or by a piano.

In a preferred embodiment, the audio signal unit has an input for an event signal and is designed to generate the audio signal as a function of the event signal. Such an event signal can represent e.g. confirmation by the hearing aid of a successfully executed user interaction. For example, the hearing aid can generate the event signal after a successful changeover to another hearing program. An event signal can advantageously represent the status of a process being executed in the hearing aid. In another embodiment, the hearing aid can generate the event signal as a function of a residual electric charge in a battery of the hearing aid. Thus the hearing aid can, for example, generate an event signal corresponding to an exhausted battery.

For example, the event signal corresponding to the exhausted battery can be assigned a predetermined audio signal representing a predetermined melody or a predetermined instrumental sound, in particular with a falling tone frequency.

For example, an audio signal representing a telephone ringing, in particular a telephone bell, can be assigned to an event representing a changeover to a telephone program. A signal representing noise can be assigned to an event representing a changeover to an interference noise program.

In another embodiment of the hearing aid, the audio signal is formed by sampling values each representing an audio signal amplitude at a sampling instant. In this embodiment of the hearing aid, the hearing aid can have a memory for a plurality of audio signal data records each representing mutually different audio signals. In this embodiment of the hearing aid, the hearing aid, in particular the audio signal unit, can have a digital/analog converter which is designed to generate an audio signal as a function of an audio signal data record received on the input side.

Further exemplary embodiments for a hearing aid will emerge from the features set forth in the dependent claims or from a combination of same.

BRIEF DESCRIPTION OF THE DRAWINGS

The invention will now be described with reference to the accompanying drawings and further examples FIG. 1 schematically illustrates an example of a hearing aid with an audio signal unit.

DETAILED DESCRIPTION OF THE INVENTION

Figure 1:
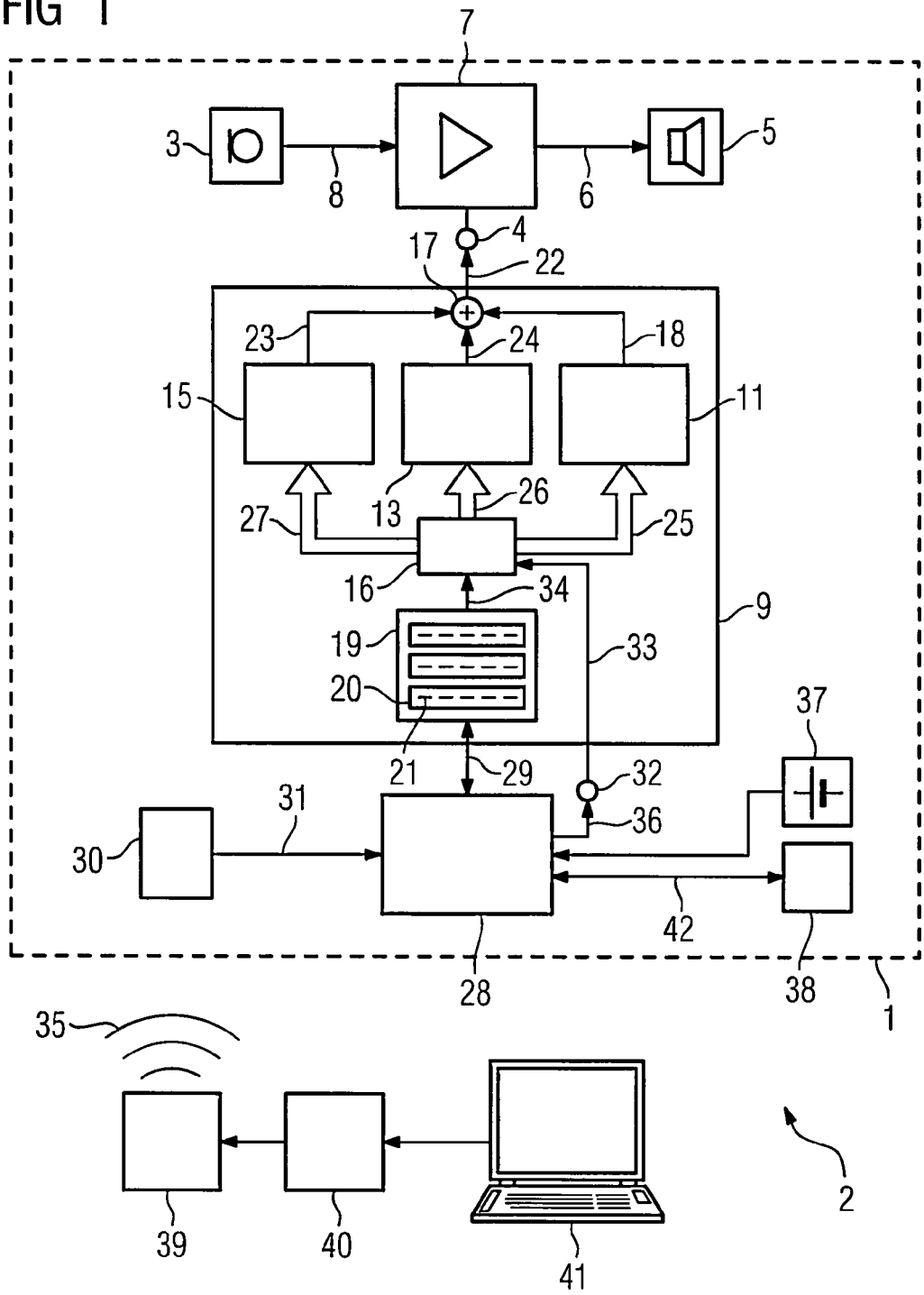

FIG. 1 is a schematic drawing of an example of a hearing aid 1. The hearing aid has a sound receiver 3 and a sound generator 5. The sound generator 5 is connected to a transmission unit 7 via a connecting line 6. The transmission unit 7 is connected on the input side via a connecting line 8 to the sound receiver 3 and on the output side via the connecting line 6 to a sound generator 5. The operation and interaction of the transmission unit 7, the sound receiver 3, and the sound generator 5 are as already explained above. The transmission unit 7 has an input 4 for an audio signal and is designed to generate a power signal representing the audio signal and to transmit it via the connecting line 6 to the sound generator 15 on the output side.

Figure 2:
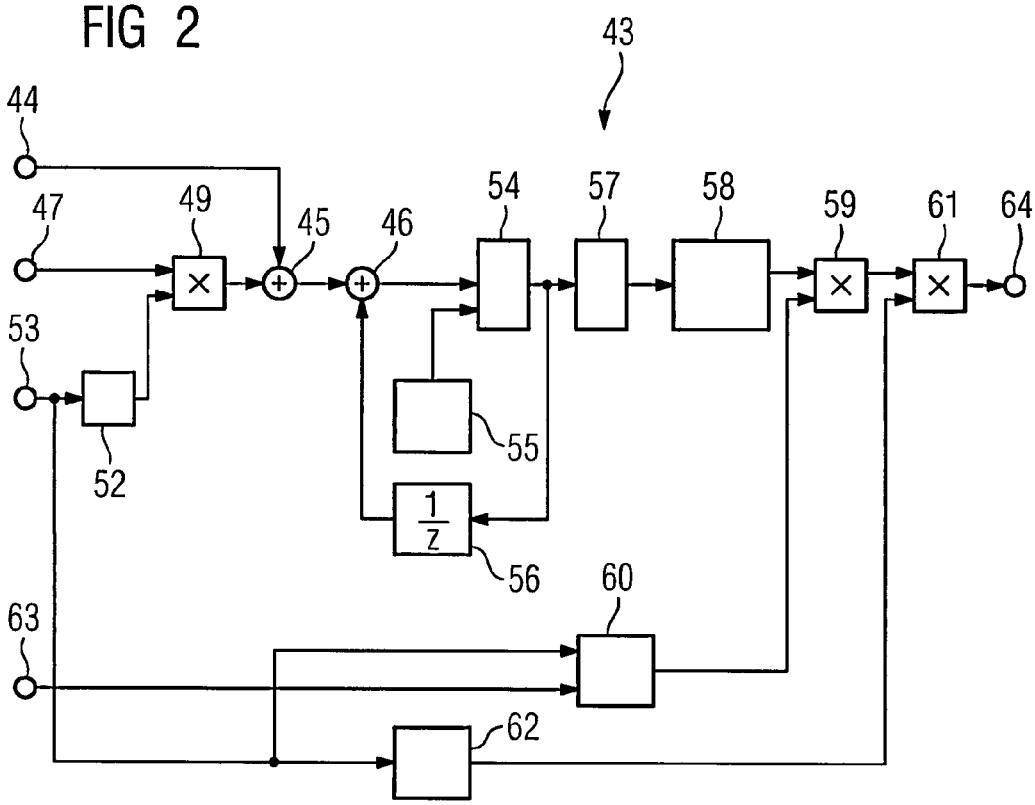
FIG. 2 schematically illustrates an example of a tone generator.

The hearing aid 1 has an audio signal unit 9 which is connected on the output side to the input 4 for the audio signal. The audio signal unit 9 is designed to generate, as a function of an event signal received on the input side, an audio signal perceptible to a human ear and having a plurality of mutually different frequencies of a frequency range. The event signal represents an event such as a status of the hearing aid 1, in particular a status of an operating sequence of the hearing aid 1, e.g. a charging state of a battery connected to the hearing aid 1 or a response of the hearing aid 1 to a user interaction. The audio signal unit 9 has a tone generator 11, a tone generator 13 and a tone generator 15. The tone generator 11, the tone generator 13 and the tone generator 15 can each be constituted by at least two individual tone generators. An exemplary embodiment of an individual tone generator is shown in FIG. 2, denoted by reference numeral 43.

The tone generators 11, 13 and 15 are each designed to generate a tone signal by means of modulation synthesis, and in particular using an additional frequency modulation and/or amplitude modulation, as a function of generation parameters received on the input side and to output said tone signal on the output side. The audio signal can be formed from a sum of the tone signals. The tone generator 11 is connected on the output side via a connecting line 18 to an adder 17. The tone generator 15 is connected on the output side to the adder 17 via a connecting line 23 and the tone generator 13 is connected on the output side to the adder 17 via a connecting line 24. The adder 17 is designed to add together received tone signals and to generate the audio signal which represents a sum of the tone signals received by the adder 17 on the input side. The adder 17 is connected on the output side via a connecting line 22 to the input 4 of the transmission unit 7.

The audio signal unit 9 has a memory 19 for data records. A data record 20 is designated by way of example. The data records are constituted in each case by codewords, each codeword representing at least one generation parameter for generating a tone signal. The codeword 21 of the data record 20 is designated by way of example. A generation parameter can be, for example, a fundamental frequency, a harmonic spectrum, a volume, an amplitude modulation level, a frequency modulation level, or an assignment to a predetermined tone generator. The data records can therefore each represent a melody.

The audio signal unit 9 also has a control unit 16. On the output side, the control unit 16 is connected to the tone generator 11 via a data bus 25, to the tone generator 13 via a data bus 26, and to the tone generator 15 via a data bus 27. The control unit 16 is connected on the input side via a connecting line 14 to the memory 9. The audio signal unit 9 has an input 32 for an event signal. The control unit 16 is connected on the input side via a connecting line 33 to the input 32 for the event signal. The control unit 16 is designed to read out a data record, e.g. the data record 20, from the memory 19 via the connecting line 34 as a function of an event signal received on the input side and to interpret the data record 20 on a codeword-by-codeword basis and to output on the output side, for each codeword, a generation parameter corresponding to the codeword.

The memory 19 is connected to a central control unit 28 of the hearing aid 1 via a connecting line 29. The central control unit 28 is designed to control an operating sequence of the hearing aid 1 and is connected on the input side via a connecting line 31 to an interface 30, and on the output side via a connecting line 36 to the input 32 for the event signal.

The central control unit 28 is connected on the input side to a sensor 37 for detecting a charging state of a battery connected to the hearing aid. The sensor 37 is designed to generate a sensor signal corresponding to a predetermined charging state of the connected battery and to output said signal on the output side.

The hearing aid 1 also has a system test unit 38 which is connected to the central control unit 28 via a connecting line 42. The system test unit 38 can test at least one component of the hearing aid 1, e.g. the transmission unit 7, as a function of a control signal and generate a status signal corresponding to the test result and output said status signal on the output side. The central control unit 28 can, for example, send a control signal for testing the hearing aid 1 to the system test unit 38, whereupon the system test unit 38 can test the at least one component of the hearing aid 1 and send the status signal corresponding to the test result back to the central control unit via the connecting line 42 on the output side. The central control unit 28 can then generate an event signal which represents a status corresponding to the test result and transmit said event signal on the output side via the connecting line 36 to the input 32 and from there via the connecting line 33 to the control unit 16.

As a function of the event signal received on the input side, the control unit 16 can read out a data record corresponding thereto from the memory 19 via the connecting line 34 and generate by means of the tone generator 11, 13 or 15 or a combination thereof an audio signal representing a melody corresponding to the data record read out.

The interface 30 can be designed for cordless reception of a transmitted data record. The central control unit can receive, e.g. as a function of a user interaction signal, a transmitted data record 35 via the interface 30 and the connecting line 31 and store it in the memory 19 via the connecting line 29. In this way the memory 19 can store mutually different data records each representing mutually different melodies.

In another embodiment, the central control unit can generate an event signal as a function of a charging state signal received on the input side. In a similar manner to the above-described procedure, the audio signal unit 9 can generate an audio signal representing a melody corresponding to the charging state as a function of an event signal received at the input 32 and representing the charging state of a battery connected to the hearing aid 1.

Also shown is a system 2 comprising the hearing aid 1 and an interface 39 for cordless transmission of data records. The system 2 also comprises a midi converter (midi=musical instrument digital interface). The system 2 also has a personal computer 41 in the form of a laptop which is designed to connect to the midi converter 40 e.g. via a USB interface (USB=universal serial bus). The interfaces 39 and 30 can each be implemented as a magnetic near field interface or as and infrared interface. The midi converter 40 is connected to the interface 39. The personal computer 41 can generate e.g. a midi signal designed for generating a data record, e.g. the data record 20, and transmit said signal to the midi converter 40. The midi converter 40 can generate a data record, e.g. the data record 20, from the midi signal and transmit said data record by means of the interface 39 to the hearing aid 1 as the transmitted data record 35.

Figure 3:
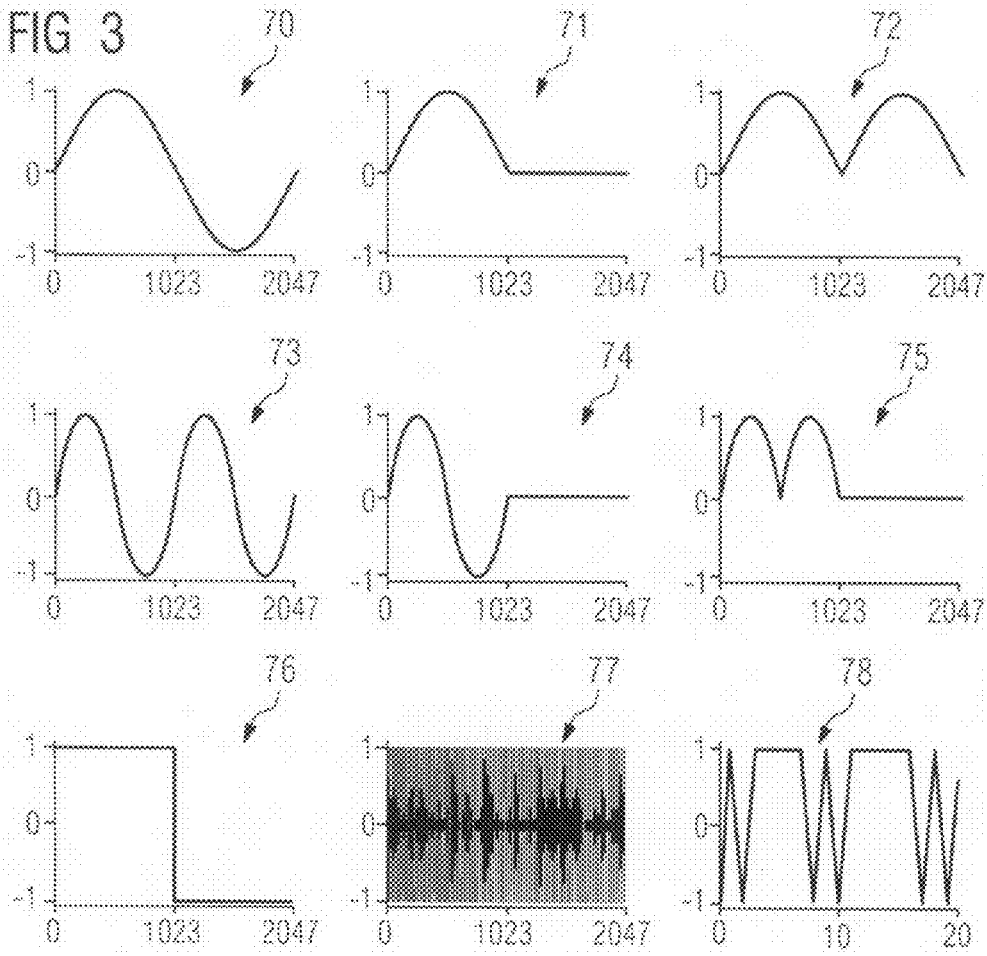
FIG. 3 schematically illustrates an example of waveforms for a tone generator FIG. 4 schematically illustrates an example of an audio signal amplitude envelope.

In this way the hearing aid 1 can receive and store mutually different melodies. The hearing aid 1 can be designed to assign at least one predefined event to a data record, e.g. the data record 20. Examples of waveforms that can be used by the tone generator 11, 13 or 15 as the basis for generating a tone signal are shown in FIG. 3.

FIG. 2 shows an example of a tone generator 43 which can, for example, at least partially constitute the tone generator 11, 13 or 15 shown in FIG. 1. The tone generator 43 has a feedback input 44 which is connected to a first input of an adder 45 of the tone generator 43. The tone generator 43 also has an adder 46 which is connected on the input side to an output of the adder 45. The adder 45 is connected on the input side to an output of a multiplier 49. The multiplier 49 is connected on the input side to a frequency input 47 of the tone generator 43. The multiplier 49 is also connected on the input side to an output of a vibrato element 52 for generating a frequency modulation. The vibrato element 52 is connected on the input side to a trigger input 53 of the tone generator 43. The multiplier 49 is designed to multiply signals received on the input side and to generate an output signal corresponding to the multiplication result.

The adders 45 and 46 are designed to add together signals received on the input side and to generate an output signal corresponding to a sum of the signals received on the input side. The adder 46 is connected on the output side to a modulo element 54 of the tone generator 43. The modulo element 54 is also connected on the input side to a wavelength memory 45. The modulo element 54 is designed to divide the output signal received from the adder 46 by the numerical value received from the wavelength memory 55 and to generate an output signal representing the remainder and output said signal on the output side. The modulo element 54 is connected on the output side to an input of a delay element 56. The delay element 56 is connected on the output side to an input of the adder 46. This means that an output signal generated by the modulo element 54 is buffered and taken into account for a subsequent arithmetic operation of summing. The modulo element 54 is also connected on the output side to a rounding element 57.

In this embodiment, the rounding element is designed to round a numerical value received on the input side and representing a numerical number to a numerical value having a predefined number of decimal places. In this example, the rounding element is designed to generate an output signal representing an integral rounding result. The rounding element 57 is connected on the output side to a waveform memory 58 of the tone generator 43.

The waveform memory 58 can be implemented as a lookup table and stores consecutive sampling values of a sampled wave period which are each assigned to an index. The sampling values each represent an amplitude value at a sampling instant. The sampling instant will also be referred to herein-after as the index. The wave memory 58 is designed to select an index corresponding to a signal received on the input side and to generate an output signal representing an amplitude value assigned to the index selected.

The wavelength memory 55 stores a number of the sampling values stored in the wave memory 58. The modulo element 54 in conjunction with the wavelength memory 55 causes signals received from the adder 45 to be mapped to the indices stored in the wave memory 58. The wave memory 58 is connected on the output side to a first input of a multiplier 59. A second input of the multiplier 59 is connected to an output of an envelope element 60. The multiplier 59 is connected on the output side to a first input of a multiplier 61. A second input of a multiplier 61 is connected to an output of a tremolo element implemented as an amplitude modulation element. The multiplier 61 is connected on the output side to an output 64 of the signal generator 43. The envelope element 60 has a trigger input which is connected to the trigger input 53 of the tone generator 43. The tremolo element 62 has a trigger input which is connected to the trigger input 53 of the tone generator 43. The envelope element 60 has a tone stop input 63 which is connected to a tone stop input 63 of the tone generator 43.

The operation of the tone generator 43 will now be described below:

When a trigger signal is present at the trigger input 53, the vibrato element 52 can generate a modulation frequency as a function of the trigger signal received on the input side and feed it out on the output side. A frequency present at the frequency input 47 is multiplied by the multiplier 49 by the modulation frequency generated by the vibrato element 52 and fed out to the adder 45. In the case of no feedback, the output signal generated by the multiplier 49 is output by the adder 45 on the output side to the adder 46. In the subsequent signal response, the frequency to be generated is now mapped by the modulo element 54, the wavelength memory 55 and the delay element 56, and additionally in conjunction with the rounding element 57, to the indices stored in the wave memory 58. As a function of the trigger signal received on the input side, the envelope element 60 generates an output signal which is multiplied by the multiplier 59 by the signal fed out by the wave memory 58. As a function of the trigger signal received at the trigger input 53, the tremolo element 62 generates an amplitude modulation signal which is received on the input side by the multiplier 61 which multiplies it by the output signal generated by the multiplier 59. The multiplier 61 generates on the output side an output signal corresponding to the multiplication result and provides it on the output side at the output 64 of the tone generator 43. In the case of a tone stop signal which is present at the tone stop input 63, the envelope element generates an output signal representing the value 0 so that the output signal generated by the multiplier 59 likewise represents a value 0.

The tone generator shown in FIG. 2 can be connected in parallel or in series with at least one other tone generator. In the case of a parallel connection, the frequency inputs of the tone generators are each connected to a common frequency input. The outputs of the parallel-connected tone generators are interconnected.

In the case of two tone generators connected in parallel, for example, a first tone generator has a feedback path from the output to the feedback input via an amplifier element. A feedback input of a second tone generator is assigned the value 0, corresponding to no frequency or a frequency of 0 Hertz.

In the case of a series connection, an output of a first tone generator is connected to a feedback input of the second tone generator. The first tone generator has a feedback path from its output to its feedback input via an amplifier element. The frequency inputs of the tone generators are interconnected and form a common frequency input. By means of the parallel or series connection, a harmonic-rich audio signal can be produced.

Also conceivable is a circuit arrangement comprising a plurality of tone generators connected to each other in parallel and/or in series.

In the case of an arrangement comprising a plurality of tone generators, a feedback input of a tone generator can be connected to an output of another tone generator or of a plurality of other tone generators.

The tone generators 11, 13 and 15 shown in FIG. 1 can each have at least two tone generators corresponding to the tone generator 43 shown in FIG. 2 which are connected in parallel or in series or, in the case of at least three tone generators, in a combined series and parallel arrangement.

FIG. 3 shows examples of waveforms which can be stored in the wave memory 58. The waveforms each represent mutually different sound characteristics. Apart from the waveform 78, the waveforms shown in FIG. 3 are each constituted by 2048 sampling values. A waveform 70 represents a sinusoidal signal which extends over all the stored 2048 sampling values. A waveform 71 shows a sinusoidal half-wave extending from sampling value 0 to sampling value 1023. From the sampling value 1024 to a sampling value 2047, the waveform 71 has a signal amplitude 0. A waveform 71 represents a first sinusoidal half-wave having positive amplitude values and extending from the sampling value 0 to a sampling value 1023. From the sampling value 1024 to a sampling value 2047, there extends a second sinusoidal half-wave having positive amplitude values.

A waveform 73 represents two consecutive sinusoidal wave periods, a first period extending between a sampling value 0 and a sampling value 1023 and a second wave period extending between a sampling value 1024 and a sampling value 2047. Also shown is a waveform 74 representing a sinusoidal wave period which extends between a sampling value 0 and a sampling value 1023. Between a sampling value 1024 and a sampling value 2047, a signal amplitude is 0. A waveform 75 represents two sinusoidal half-waves each with positive amplitude values, a first sinusoidal half-wave extending between a sampling value 0 and a sampling value 500 and a second sinusoidal half-wave extending between a sampling value 501 and a sampling value 1023. Between the sampling values 1024 and 2047, a signal amplitude is 0. A waveform 76 represents a square wave signal, whereby sampling values extending between a sampling value 0 and a sampling value 1023 have an amplitude value 1 and sampling values extending between a sampling value 1024 and 2047 have a value −1. Also shown is a waveform 77 representing white noise. The white noise has a maximum signal amplitude extending between an amplitude value −1 and an amplitude value 1. A waveform 78 shows a time segment of the waveform 77 illustrated and has 20 sampling values.

Figure 4:
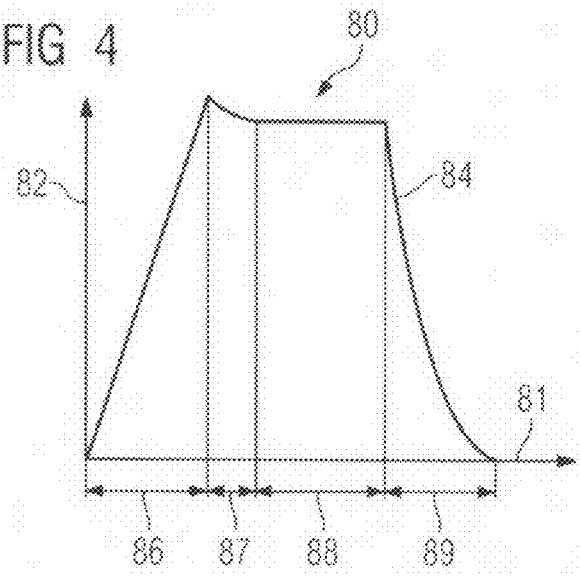

FIG. 4 shows a diagram 80. The diagram 80 shows a graph 84 representing an amplitude envelope of an audio signal segment. The audio signal segment can represent at least one tone or a chord as part of a melody formed from tones and/or chords and capable of having been generated by a tone generator. In this embodiment, the audio signal segment has four mutually different phases, namely an attack phase, a decay phase, a sustain phase and a release phase.

The diagram 80 has an abscissa 81 and an ordinate 82. The time is plotted on the abscissa 81 and an audio signal amplitude is plotted on the ordinate 82.

Marked on the abscissa 81 are time segments 86, 87, 88 and 89. The time segment 86 represents an attack phase of the audio signal segment. The time segment 87 represents a decay phase of the audio signal segment. The time segment 88 represents a sustain phase of the audio signal segment. The time segment 89 represents a release phase of the audio signal segment in which the curve of the amplitude envelope falls off.

The invention claimed is:

1. A hearing aid, comprising:

a sound receiver coupled to receive sound waves and generate a microphone signal representing the sound waves;

a transmission unit coupled to receive the microphone signal and generate a power signal as a function of the microphone signal;

a sound generator coupled to receive the power signal and generate a sound as a function of the power signal;

an audio signal unit coupled to the sound generator and comprises a plurality of tone generators configured to generate respective audio signals with respective fundamental frequency representing a tone and harmonics of the fundamental frequency, wherein the respective audio signals are generated in response to an event signal, wherein at least one of the plurality of tone generators is configured to generate an audio signal based at least in part on a frequency modulation synthesis and comprising a plurality of frequency components over a frequency range, which is sufficiently wide to be perceived by a hearing-impaired user, wherein the respective audio signals comprise tones or chords assigned to convey acoustic information to the hearing-impaired user effective to identify a predefined hearing aid event comprising a change of a hearing program for the hearing aid; and a summer coupled to receive the respective audio signals from the plurality of tone generators to supply a summer output signal comprising a sum of the respective audio signals from the plurality of tone generators, wherein the summer audio signal comprises a plurality of mutually different frequencies extending over a sufficiently wide frequency range so that the hearing-impaired user of the hearing device can perceive the summer audio signal.

2. The hearing aid as claimed in claim 1, wherein at least one of the plurality of tone generators generates an audio signal at least partially by an amplitude modulation.

3. The hearing aid as claimed in claim 1, wherein at least one of the plurality of tone generators comprises a vibrato element configured to generate the audio signal at least partially by an additional frequency modulation to generate a vibrato acoustic effect effective to distinguish said audio signal from an interfering acoustic noise.

4. The hearing aid as claimed in claim 1, wherein the respective audio signals are selected from the group consisting of: an instrumental sound, a vocal sound, and a noise signal.

5. The hearing aid as claimed in claim 1, wherein an audio signal segment of a respective audio signal comprises an amplitude envelope and an end phase of the audio signal segment having a falling amplitude envelope.

6. The hearing aid as claimed in claim 5, wherein the audio signal segment represents a tone.

7. A method for generating an audio signal of a hearing aid, comprising:

providing a plurality of tone generators;

generating at least in part based on a frequency modulation synthesis an audio signal in at least one of the plurality of tone generators, the generated audio signal comprising a plurality of frequency components over a frequency range, which is sufficiently wide to be perceived by a hearing-impaired user;

in response to an event signal, generating with the plurality of tone generators respective audio signals with a fundamental frequency representing a tone and harmonics of the fundamental frequency, wherein the respective audio signals comprise tones or chords assigned to convey acoustic information to the hearing-impaired user effective to identify a predefined hearing aid event comprising a change of a hearing program for the hearing aid;

coupling the plurality of tone generators to a summer arranged to receive the respective audio signals from the plurality of tone generators and supply a summer output signal comprising a sum of the respective audio signals from the plurality of tone generators, wherein the summer audio signal comprises a plurality of mutually different frequencies extending over a frequency range; and defining the frequency range so that a hearing-impaired user of the hearing device can perceive the summer audio signal.

8. The method as claimed in claim 7, wherein an audio signal from at least one of the plurality of tone generators is generated at least partially by an amplitude modulation.

9. The method as claimed in claim 7, wherein an audio signal from at least one of the plurality of tone generators is generated at least partially by an additional frequency modulation that is generated by a vibrato element configured to provide a vibrato acoustic effect effective to distinguish said audio signal from an interfering acoustic noise.

10. The method as claimed in claim 7, wherein the respective audio signal is selected from the group consisting of: an instrumental sound, a vocal sound, and a noise signal.

11. The method as claimed in claim 7, wherein an audio signal segment of a respective audio signal comprises an amplitude envelope and an end phase of the audio signal segment having a falling amplitude envelope.

12. The method as claimed in claim 11, wherein the audio signal segment represents a tone.

13. The hearing aid as claimed in claim 1, wherein the event further comprises an event selected from the group consisting of a change in the volume of the hearing aid, an status of a process being executed by the hearing aid, and a physical condition of a component of the hearing aid.

14. The method as claimed in claim 7, wherein the event further comprises an event selected from the group consisting of a change in a volume of the hearing aid, an status of a process being executed by the hearing aid, and a physical condition of a component of the hearing aid.

* * * * *